US010711550B2

(12) United States Patent
Wang et al.

(10) Patent No.: US 10,711,550 B2
(45) Date of Patent: Jul. 14, 2020

(54) ENERGY-SAVING AND ENVIRONMENT-FRIENDLY PARAFFIN AND SCALE CONTROL ULTRA-STRONG VISCOSITY REDUCTION DEVICE

(71) Applicant: SHANDONG QUNFENG PETROLEUM TECHNOLOGY DEVELOPMENT CO., LTD., Qingdao, Shandong (CN)

(72) Inventors: Biqi Wang, Hubei (CN); Bozhi Yang, Hubei (CN); Changhai Wang, Hubei (CN)

(73) Assignee: Shandong Qunfeng Petroleum Technology Development Co., Ltd., Shandong (CN)

( * ) Notice: Subject to any disclaimer, the term of this patent is extended or adjusted under 35 U.S.C. 154(b) by 0 days.

(21) Appl. No.: 15/773,913

(22) PCT Filed: Nov. 7, 2016

(86) PCT No.: PCT/CN2016/104942
§ 371 (c)(1),
(2) Date: May 4, 2018

(87) PCT Pub. No.: WO2017/076368
PCT Pub. Date: May 11, 2017

(65) Prior Publication Data

US 2018/0340389 A1 Nov. 29, 2018

(30) Foreign Application Priority Data

Nov. 6, 2015 (CN) ..... 2015 1 0745951

(51) Int. Cl.
*E21B 37/00* (2006.01)
*E21B 28/00* (2006.01)
(Continued)

(52) U.S. Cl.
CPC ..... *E21B 28/00* (2013.01); *B08B 3/12* (2013.01); *B08B 17/00* (2013.01); *E21B 37/00* (2013.01)

(58) Field of Classification Search
CPC combination set(s) only.
See application file for complete search history.

(56) References Cited

U.S. PATENT DOCUMENTS 6,474,349 B1 11/2002 Laker
2005/0006088 A1* 1/2005 Abramov ..... E21B 28/00 166/249

FOREIGN PATENT DOCUMENTS

WO WO-2009000177 A1 * 12/2008 ..... E21B 37/00

OTHER PUBLICATIONS

International Search Report dated Jan. 24, 2017.
English first search of priority document CN201510745951.

* cited by examiner

*Primary Examiner* — Taras P Bemko
*Assistant Examiner* — Ronald R Runyan
(74) *Attorney, Agent, or Firm* — Amster, Rothstein & Ebenstein LLP

(57) ABSTRACT

An energy-saving environment-friendly paraffin-control scale preventing ultra-strong viscosity reduction device comprises: a hydrocyclone, a first-stage jet ultrasonic signal generator, a second-stage jet ultrasonic oscillator and an ultrasonic cavitation cavity which are butted in sequence; the hydrocyclone serves as an inlet end, the outer end of the ultrasonic cavitation cavity serves as an outlet, a section of oscillation cavity is additionally arranged behind the second-stage jet ultrasonic oscillator and before the ultrasonic cavitation cavity, the tail part of the oscillation cavity is provided with a third-stage jet ultrasonic oscillator, and the
(Continued)

ultrasonic cavitation cavity is then connected behind the third-stage jet ultrasonic oscillator.

4 Claims, 2 Drawing Sheets

(51) Int. Cl.
*B08B 17/00* (2006.01)
*B08B 3/12* (2006.01)

ENERGY-SAVING AND ENVIRONMENT-FRIENDLY PARAFFIN AND SCALE CONTROL ULTRA-STRONG VISCOSITY REDUCTION DEVICE

TECHNICAL FIELD

The present disclosure, relating to oil mining equipment, is an energy-saving environment-friendly paraffin-control scale-preventing ultra-strong viscosity reduction device (energy-saving and environment-friendly paraffin and scale control ultra-strong viscosity reduction device, i.e. an ultra-strong viscosity reduction device capable of saving energy, being environment friendly, controlling paraffin and preventing scale) for downhole oil pumping.

BACKGROUND ART

Among the existing oil fields in China, oil wells of medium to high paraffin-content, for which the paraffin content in crude oil reaches 10%-40%, account for 80% or greater, in which the paraffin content is high, the crude oil has high viscosity and poor fluidity, and is very easy to coagulate and accumulate, thereby causing paraffin precipitation, scaling and blocking of the upper and lower portions of the oil screen and the oil well pump, increasing the useless power consumption of the oil well pump, reducing the oil pump capacity, and even completely blocking the wellbore to cause production stop.

In order to solve the worldwide problem of oil field production that paraffin in the crude oil crystallizes to block the well, paraffin-control viscosity reduction products have been developed in recent years. At present, the technologies adopted by this kind of products all belong to the technology scope of jet ultrasonic theory. Structures of the earlier products consist of a jet flow generator, an ultrasonic oscillator, a cavitation cavity, a vortex director and a vortex ejector, which can be regarded as the first-generation jet ultrasonic paraffin-control viscosity reduction products. The problems thereof are: the structures of the products are unreasonable and unscientific, and the sound field intensity of ultrasonic wave is weak, resulting in very limited paraffin control and viscosity reducing effects. To this end, the inventors filed an application "Environment-friendly Paraffin-Control Scale-Preventing Ultra-strong Viscosity Reduction Device" for a patent of an invention on Jun. 22, 2007, which has already been granted a patent right with the patent No. ZL200710052537.2. The invention greatly improves the effects of controlling paraffin, reducing viscosity and preventing scaling, and the products thereof can be regarded as the second-generation jet ultrasonic paraffin-control viscosity reduction products. However, the products still have four main problems when used in deep wells, high-paraffin-content wells and heavy oil wells (greater than 1,000 mPa·S): first, as the products performs ultrasonic treatment on pumped (extracted) crude oil mainly by ultra-strong sound waves, when the daily output of the crude oil is large, the intensity of the sound waves is relatively insufficient; second, for high-paraffin-content wells with low water content, certain paraffin control effect can be achieved, but the paraffin control effect is insufficient; third, when the oil well has a large depth, the longer the distance for the treatment of the crude oil by ultrasonic waves is, the weaker the sound field intensity is; and fourth, for the oil wells with relatively large viscosity, generally, only the method of thermal recovery (thermal production) or injection production (i.e., a periodic gas injection or cyclical gas injection method, which comprises injecting a certain amount of wet saturated steam, which is under a high temperature and a high pressure, into an oil layer to heat the crude oil in the oil layer, and then opening the well for recovery. For the thermal recovery of heavy oil by periodic gas injection, a conventional oil pump with a double-hollow sucker rod having an electric heating device is used; and for the thermal recovery of heavy oil by cyclical gas injection, in addition to a double-hollow sucker rod having an electric heating device, the oil pumping system is further provided with a mechanism capable of directly injecting gas from the ground wellhead to the heavy oil layer after shutdown of the machine and stopping of mining, which mechanism injects gas after stopping of extraction (pumping) and extracts (pumps) oil after startup of the machine, and is referred to as an injection-extraction integrated thermal-recovery heavy oil pumping machine. The electric heating device of the double-hollow sucker rod is an auxiliary heating device for heating the crude oil when the viscosity is greatly increased due to continuous decrease of the temperature during the rising process of the crude oil.) can be used, the first-generation products and the second-generation products cannot achieve expected effects, because at the time of thermal recovery or injection production, the oil pumping and the injection of hot gas flow are carried out alternately. First, a hot gas flow is injected to downhole to heat the heavy oil to reduce the viscosity thereof, and then oil pumping is carried out. In the use of the products, the jet opening of the jet nozzle is small and the amount of the heating gas is limited, which greatly affects the viscosity reduction effect, thereby limiting the use of the products.

SUMMARY

An object of the present disclosure is to solve the problems, e.g., the problem that the prior products of the same kind do not have ideal paraffin-control, scale-preventing and viscosity-reduction effects, and especially cannot be applied to oil extraction of heavy oil wells (greater than 1,000 mPa·S), and an energy-saving environment-friendly paraffin-control scale-preventing ultra-strong viscosity reduction device is provided.

The specific solution of the present disclosure comprises: performing further improvements on the second-generation jet ultrasonic paraffin-control viscosity reduction device, the resultant product comprising a hydrocyclone, a first-stage jet ultrasonic signal generator, a second-stage jet ultrasonic oscillator, and an ultrasonic cavitation cavity which are butted in sequence; the hydrocyclone serving as an inlet end, the outer end of the ultrasonic cavitation cavity serving as an outlet, characterized in that a section of oscillation cavity is additionally arranged behind the second-stage jet ultrasonic oscillator and before the ultrasonic cavitation cavity, the tail part of the oscillation cavity is provided with a third-stage jet ultrasonic oscillator, and the ultrasonic cavitation cavity is then connected behind the third-stage jet ultrasonic oscillator.

In the present disclosure, the first-stage jet ultrasonic signal generator, the second-stage jet ultrasonic oscillator and the third-stage jet ultrasonic oscillator have substantially the same structure, each comprising a pipe barrel, a jet device base being arranged in a front section of the pipe barrel, a jet nozzle being embedded in the jet device base, the jet opening of the jet nozzle being in a rectangular flat shape, a hot gas flow channel being formed at one side or two sides of the jet opening in the jet nozzle, a one-way valve being mounted in the hot gas flow channel, the one-way valve being mounted to have a flow direction opposite to the flowing direction of pumped oil; a leaf spring being suspended at a rear section of the jet device base, and the leaf spring being arranged to be right opposite to the jet opening of the jet nozzle.

In the present disclosure, in the first-stage jet ultrasonic signal generator, a width of the leaf spring is equal to a width of the jet opening of the jet nozzle.

In the present disclosure, in each of the second-stage jet ultrasonic oscillator and the third-stage jet ultrasonic oscillator, a width of the leaf spring is equal to the width of the jet opening of corresponding jet nozzle.

In the present disclosure, the length of the oscillation cavity is ≥500 mm.

In the present disclosure, the length of the ultrasonic cavitation cavity is larger than that of the oscillation cavity.

The present disclosure takes rotational flow, jet flow and ultrasound technologies as the basic principles, to make a certain volume of liquid become a liquid with a certain oscillation frequency. After the crude oil has been subjected to the first-stage jet ultrasonic signal generator and the second-stage jet ultrasonic oscillator, a liquid A with a certain oscillation frequency is generated in a newly arranged oscillation cavity. Under the action of strong jet flows and strong ultrasonic waves, the liquid will generate higher and stronger ultrasonic oscillation, which is referred to as oscillation frequency liquid B. Under the action of the oil well pump, the liquid molecules flow from bottom to top along the oil pipe in a colliding and oscillating manner, continuously cleaning, in an oscillating manner, the oil pump, the oil pipe wall and the sucker rod. In the flowing process of the crude oil, the attenuation of the oscillation is automatically compensated by the third-stage ultrasonic oscillator supplementing the energy of vibration, thereby forming a liquid having higher and stronger ultrasonic oscillation. Under the oscillating state, the flowing resistance of the crude oil is greatly reduced to such an extent that the surfaces of the oil pump, the oil pipe wall and the sucker rod are smooth and have no paraffin and scales, which reduces the abrasion and rusting of the surfaces of the oil pump, the oil pipe wall and the sucker rod, greatly prolongs the service cycle and the well-flushing period of the oil pump, the oil pipe and the sucker rod, and improves the functions of environmental protection, energy saving, paraffin control, scale preventing and viscosity reduction to such an extent that the specific yield of crude oil is maximized.

The present disclosure has the following advantages:

1. The effects of controlling paraffin, preventing scale and reducing viscosity are remarkably enhanced due to the addition of the oscillation cavity and the third-stage ultrasonic oscillator.

2. Particularly, in each jet nozzle, a gas flow channel is added, and a one-way valve is mounted, wherein at the time of oil pumping, the one-way valve is closed, so that the crude oil can only flow out through the jet nozzle, generating oscillation; and at the time of gas injecting, the one-way valve is opened, which ensures sufficient injection amount of saturated steam. Thus, the applicability of the present disclosure is greatly improved, which can be used for thermal recovery or injection production, realizing the application to heavy oil wells.

3. For the oil production of injection-extraction integrated thermal recovery heavy oil wells and common thermal-recovery heavy oil wells, the use of the electric heating device of the double-hollow rod can be reduced or avoided.

4. The environmental protection function: the traditional chemical paraffin-control cleaning is omitted or reduced, and no any pollution is caused to the oil layer, the underground water and the earth surface.

5. The energy-saving function: the well-flushing period is prolonged, the specific yield is increased; the manual maintenance amount is small, and the electric energy and heat energy are reduced.

6. The paraffin-control and scale-preventing function: the surfaces of the oil pump, the oil pipe wall and the sucker rod are smooth and have no paraffin and scales, and there is no paraffin precipitation or scaling phenomena.

7. The anti-corrosion function: the abrasion and rusting of the surfaces of the oil pump, the oil pipe wall and the sucker rod are greatly reduced, and the service life of the device is prolonged.

Figure 1:
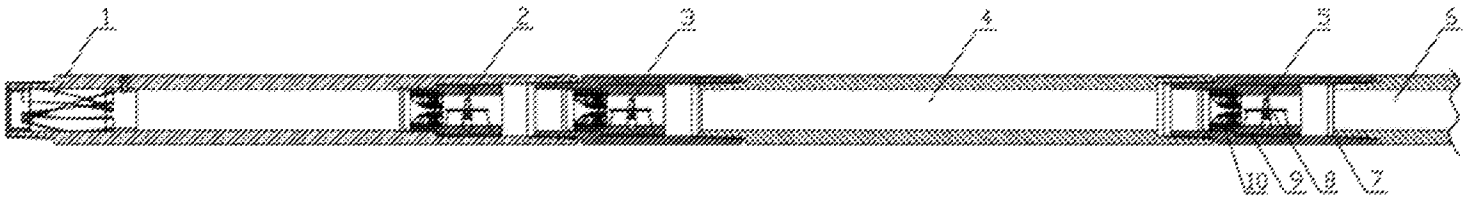
FIG. 1 is a main sectional view of an overall structure of the present disclosure.

In the drawings: 1—hydrocyclone, 2—first-stage jet ultrasonic signal generator, 3—second-stage jet ultrasonic oscillator, 4—fixed oscillation cavity, 5—third-stage jet ultrasonic oscillator, 6—ultrasonic cavitation cavity, 7—pipe barrel, 8—leaf spring, 9—jet device base, 10—jet nozzle, 11—gas flow channel, 12—one-way valve, 13—jet opening.

DETAILED DESCRIPTION OF EMBODIMENTS

Figure 2:
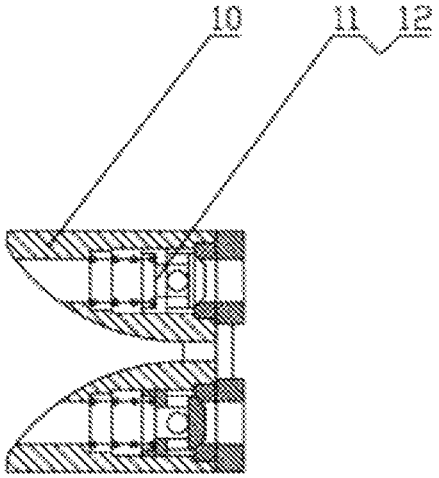
FIG. 2 is an enlarged view of a jet nozzle.
Figure 3:
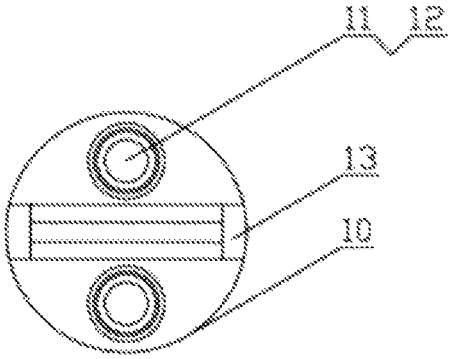
FIG. 3 is an enlarged right view of the jet nozzle.

Referring to FIGS. 1-3, the present disclosure comprises a hydrocyclone 1, a first-stage jet ultrasonic signal generator 2, a second-stage jet ultrasonic oscillator 3, and an ultrasonic cavitation cavity 6 which are butted in sequence. The hydrocyclone 1 serves as an inlet end, the outer end of the ultrasonic cavitation cavity 6 serves as an outlet, a section of oscillation cavity 4 is particularly additionally arranged behind the second-stage jet ultrasonic oscillator 3 and before the ultrasonic cavitation cavity 6, the tail part of the oscillation cavity 4 is provided with a third-stage jet ultrasonic oscillator 5, and the ultrasonic cavitation cavity 6 is then connected behind the third-stage jet ultrasonic oscillator 5.

In the present embodiment, the first-stage jet ultrasonic signal generator 2, the second-stage jet ultrasonic oscillator 3 and the third-stage jet ultrasonic oscillator 5 have substantially the same structure, each comprising a pipe barrel 7. A jet device base 9 is arranged in a front section of the pipe barrel 7. A jet nozzle 10 is embedded in the jet device base 9. The jet opening 13 of the jet nozzle 10 is in a rectangular flat shape. A saturated steam flow channel 11 is formed at one side or two sides of the jet opening 13 in the jet nozzle 10. A one-way valve 12 is mounted in the steam flow channel 11. The one-way valve 12 is mounted to have a flow direction opposite to the flowing direction of pumped oil. A leaf spring 8 is suspended at a rear section of the jet device base 9. The leaf spring 8 is arranged to be right opposite to the jet opening 13 of the jet nozzle 10.

In the present embodiment, in the first-stage jet ultrasonic signal generator 2, the width of the leaf spring 8 is equal to a width of the jet opening 13 of the jet nozzle 10.

In the present embodiment, in each of the second-stage jet ultrasonic oscillator 3 and the third-stage jet ultrasonic oscillator 5, the width of the leaf spring is equal to the width of the jet opening 13 of the jet nozzle 10.

In the present embodiment, the length of the oscillation cavity 4 is ≥680 mm (generally, the length shall be larger than 500 mm in order to ensure superior effects, and the specific length shall be set according to the parameters of the oil well, in order to achieve the optimal effects).

In the present embodiment, the length of the ultrasonic cavitation cavity is 1,000 mm (generally, the length shall be larger than that of the oscillation cavity).

The invention claimed is:

1. An energy-saving environment-friendly paraffin-control scale- preventing ultra-strong viscosity reduction device, comprising a hydrocyclone, a first-stage jet ultrasonic signal generator, a second-stage jet ultrasonic oscillator and an ultrasonic cavitation cavity which are butted in sequence; the hydrocyclone serving as an inlet end, an outer end of the ultrasonic cavitation cavity serving as an outlet, wherein a section of oscillation cavity is additionally provided behind the jet ultrasonic oscillator and before the ultrasonic cavitation cavity, a tail part of the oscillation cavity is provided with a third-stage jet ultrasonic oscillator, and the ultrasonic cavitation cavity is then connected behind the third-stage jet ultrasonic oscillator, wherein each of the first-stage jet ultrasonic signal generator, the second-stage jet ultrasonic oscillator and the third-stage jet ultrasonic oscillator comprises a pipe barrel, a jet device base being mounted in a front section of the pipe barrel, a jet nozzle being embedded in the jet device base, a jet opening of the jet nozzle being in a rectangular flat shape, a gas flow channel being formed in the jet nozzle at one side or two sides of the jet opening, a one-way valve being mounted in the gas flow channel, the one-way valve being mounted to have a flow direction opposite to a flowing direction of pumped oil; a leaf spring being suspended at a rear section of the jet device base, and the leaf spring being arranged to be right opposite to the jet opening of the jet nozzle.

2. The energy-saving environment-friendly paraffin-control scale-preventing ultra-strong viscosity reduction device according to claim 1, wherein in the first-stage jet ultrasonic signal generator, a width of the leaf spring is equal to a width of the jet opening of the jet nozzle.

3. The energy-saving environment-friendly paraffin-control scale-preventing ultra-strong viscosity reduction device according to claim 1, wherein in each of the second-stage jet ultrasonic oscillator and the third-stage jet ultrasonic oscillator, a width of the leaf spring is equal to a width of the jet opening of the jet nozzle.

4. The energy-saving environment-friendly paraffin-control scale-preventing ultra-strong viscosity reduction device according to claim 1, wherein a length of the oscillation cavity is ≥500 mm.

* * * * *